US011597642B2

(12) United States Patent
Kuo et al.

(10) Patent No.: US 11,597,642 B2
(45) Date of Patent: Mar. 7, 2023

(54) MATERIAL DISPENSING DEVICE FOR AUTOMATED BEVERAGE PREPARATION APPARATUS

(71) Applicant: Botrista Technology, Inc., Redwood City, CA (US)

(72) Inventors: Wu-Chou Kuo, Taipei (TW); Yu-Min Lee, New Taipei (TW); Jia-Hui Chen, Kaohsiung (TW); Yen-Jui Su, New Taipei (TW)

(73) Assignee: Botrista Technology, Inc., Redwood City, CA (US)

( * ) Notice: Subject to any disclaimer, the term of this patent is extended or adjusted under 35 U.S.C. 154(b) by 162 days.

(21) Appl. No.: 17/218,314

(22) Filed: Mar. 31, 2021

(65) Prior Publication Data

US 2022/0144615 A1 May 12, 2022

Related U.S. Application Data

(60) Provisional application No. 63/143,217, filed on Jan. 29, 2021, provisional application No. 63/110,621, filed on Nov. 6, 2020.

(51) Int. Cl.
*B67D 1/00* (2006.01)
*B67D 1/08* (2006.01)

(52) U.S. Cl.
CPC ..... *B67D 1/0012* (2013.01); *B67D 1/0082* (2013.01); *B67D 1/0855* (2013.01); (Continued)

(58) Field of Classification Search
CPC .. B67D 1/0012; B67D 1/0082; B67D 1/0855; B67D 2001/0094; B67D 2001/0097; B67D 2210/0005
See application file for complete search history.

(56) References Cited

U.S. PATENT DOCUMENTS 360,422 A * 4/1887 Dougherty ..... B67D 1/0425 92/92
5,179,970 A * 1/1993 Jarocki ..... B67D 1/12 251/129.08
2012/0328456 A1* 12/2012 Maisch ..... A47J 31/468 417/375

FOREIGN PATENT DOCUMENTS

CN 102781293 B 8/2015
WO WO-2010108700 A1 * 9/2010 ..... A47J 31/4403
WO WO 2011/107574 A2 9/2011

OTHER PUBLICATIONS

Taiwanese Notice of Allowance, dated Aug. 11, 2021, for Taiwanese Application No. 110112000, with an English translation.

(Continued)

*Primary Examiner* — Jeremy Carroll
(74) *Attorney, Agent, or Firm* — Birch, Stewart, Kolasch & Birch, LLP

(57) ABSTRACT

A material dispensing device, a material output volume detecting device, and a related damper device for use in an automated beverage preparation apparatus are disclosed. The material output volume detecting device includes: a damper device arranged to operably buffer liquid material flowing therethrough; and a flowmeter arranged to operably measure the flow of liquid material outputted from the damper device. The damper device includes: a damper base having a material entrance hole, a material exit hole, and a material buffer chamber positioned between the material entrance hole and the material exit hole; a diaphragm covered on the material buffer chamber; and a fastening element positioned on the diaphragm and having a hollow portion. When the volume of liquid material within the material buffer chamber exceeds a predetermined amount, the diaphragm deforms to protrude outward, so that a part of (Continued)

the diaphragm enters the hollow portion of the fastening element.

8 Claims, 15 Drawing Sheets

(52) U.S. Cl.
CPC ..... *B67D 2001/0094* (2013.01); *B67D 2001/0097* (2013.01); *B67D 2210/00052* (2013.01)

(56) References Cited

OTHER PUBLICATIONS

Taiwanese Office Action and Search Report, dated Jul. 14, 2021, for Taiwanese Application No. 110112000, with a partial English translation of the Taiwanese Office Action and a full English translation of the Taiwanese Search Report.

* cited by examiner

MATERIAL DISPENSING DEVICE FOR AUTOMATED BEVERAGE PREPARATION APPARATUS

CROSS-REFERENCE TO RELATED APPLICATIONS

This application claims the benefit of priority to U.S. Provisional Application Ser. No. 63/110,621, filed on Nov. 6, 2020; the entirety of which is incorporated herein by reference for all purposes. This application claims the benefit of priority to U.S. Provisional Application Ser. No. 63/143,217, filed on Jan. 29, 2021; the entirety of which is incorporated herein by reference for all purposes.

BACKGROUND

The disclosure generally relates to an automated beverage preparation apparatus and, more particularly, to a material dispensing device, a material output volume detecting device, and a related damper device for use in an automated beverage preparation apparatus.

For many consumers, freshly made beverages are more attractive than factory-produced canned or bottled beverages in many aspects, such as freshness, taste, and/or flexibility of customizing ingredient combination. Therefore, many restaurants and beverage vendors offer a variety of freshly made beverages to meet the needs of their customers. The traditional approach of manually preparing freshly made beverages has many disadvantages. For example, it is not easy to maintain the taste consistency of freshly made beverages, personnel training requires considerable time and cost, and the preparation of the freshly made beverages often consumes a lot of labor time, or the like. As a result of rising labor costs and other factors (e.g., increased operating costs due to the impact of the pandemic or inflation), many restaurants and beverage vendors have begun to use a variety of machinery and equipment to provide or assist in the preparation of freshly-made beverages in order to reduce the required labor time and costs.

It is well known that many raw materials for use in preparing freshly made beverages are liquid materials which have a viscosity higher than water, for example, honey, various syrups, soy milks, nut pulps, fruit juice concentrates, fruit juices containing fruit fibers, tea-based liquids containing small particles (e.g., bubbles or tapioca balls), milk-based liquids, cooking oils, or other thick liquid material and so on. However, traditional beverage preparation machines lack appropriate mechanisms to accurately measure the usage amount of the liquid material of the aforementioned type, and thus it usually results in undesirable situations, e.g., the liquid volume of the freshly made beverage does not meet expectation or the taste of the freshly made beverage has bias.

SUMMARY

An example embodiment of a material dispensing device of an automated beverage preparation apparatus is disclosed, comprising: a pump, comprising a material inlet and a material outlet, wherein the pump is arranged to operably pressure liquid material received through the material inlet to push the liquid material to the material outlet; a damper device, arranged to operably buffer liquid material flowing through the damper device; a flowmeter, coupled with the damper device, arranged to operably measure a flow of the liquid material outputted from the damper device; and a material output tube; wherein the damper device comprises: a damper base, comprising a material entrance hole, a material exit hole, and a material buffer chamber located between the material entrance hole and the material exit hole, wherein the material entrance hole is arranged to operably transmit received liquid material to the material buffer chamber, the material buffer chamber is arranged to temporarily store the liquid material flowing into the material buffer chamber, and the material exit hole is arranged to operably transmit the liquid material passed through the material buffer chamber toward the flowmeter; a diaphragm, covered on the material buffer chamber; and a fastening element, positioned on the diaphragm and having a hollow portion; wherein when a volume of the liquid material within the material buffer chamber exceeds a predetermined amount, the diaphragm deforms to protrude outward, so that a part of the diaphragm enters the hollow portion of the fastening element.

An example embodiment of a material output volume detecting device of an automated beverage preparation apparatus is disclosed, comprising: a damper device, arranged to operably buffer liquid material flowing through the damper device; and a flowmeter, coupled with the damper device, arranged to operably measure a flow of the liquid material outputted from the damper device; and wherein the damper device comprises: a damper base, comprising a material entrance hole, a material exit hole, and a material buffer chamber located between the material entrance hole and the material exit hole, wherein the material entrance hole is arranged to operably transmit received liquid material to the material buffer chamber, the material buffer chamber is arranged to temporarily store the liquid material flowing into the material buffer chamber, and the material exit hole is arranged to operably transmit the liquid material passed through the material buffer chamber toward the flowmeter; a diaphragm, covered on the material buffer chamber; and a fastening element, positioned on the diaphragm and having a hollow portion; wherein when a volume of the liquid material within the material buffer chamber exceeds a predetermined amount, the diaphragm deforms to protrude outward, so that a part of the diaphragm enters the hollow portion of the fastening element.

An example embodiment of a damper device of an automated beverage preparation apparatus is disclosed, comprising: a damper base, comprising a material entrance hole, a material exit hole, and a material buffer chamber located between the material entrance hole and the material exit hole, wherein the material entrance hole is arranged to operably transmit received liquid material to the material buffer chamber, the material buffer chamber is arranged to temporarily store the liquid material flowing into the material buffer chamber, and the material exit hole is arranged to operably output the liquid material passed through the material buffer chamber; a diaphragm, covered on the material buffer chamber; and a fastening element, positioned on the diaphragm and having a hollow portion; wherein when a volume of the liquid material within the material buffer chamber exceeds a predetermined amount, the diaphragm deforms to protrude outward, so that a part of the diaphragm enters the hollow portion of the fastening element.

Both the foregoing general description and the following detailed description are examples and explanatory only, and are not restrictive of the invention as claimed.

DETAILED DESCRIPTION

Reference is made in detail to embodiments of the invention, which are illustrated in the accompanying drawings. The same reference numbers may be used throughout the drawings to refer to the same or like parts, components, or operations.

Figure 1:
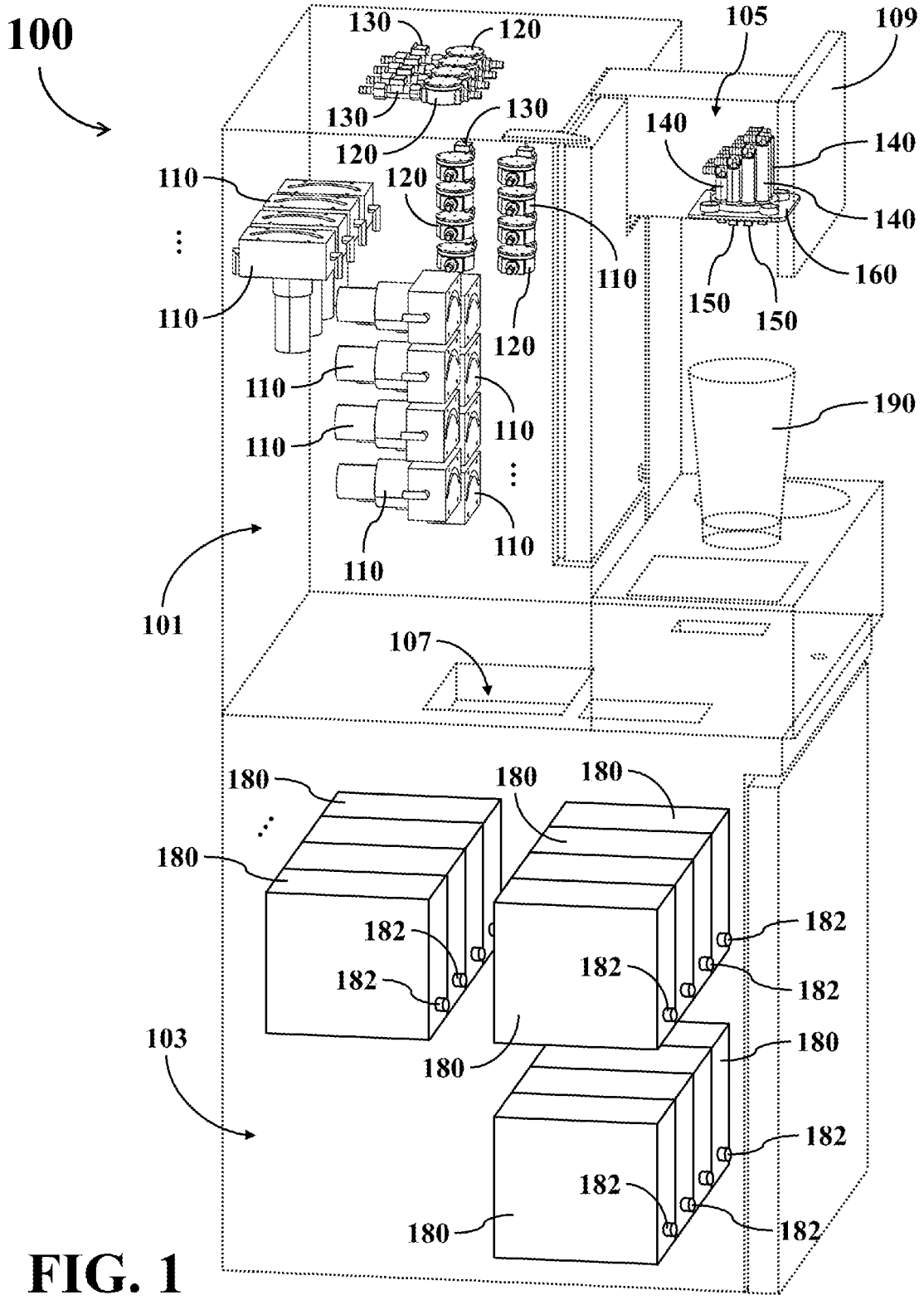
FIG. 1 shows a simplified schematic perspective diagram of an automated beverage preparation apparatus according to one embodiment of the present disclosure.
Figure 2:
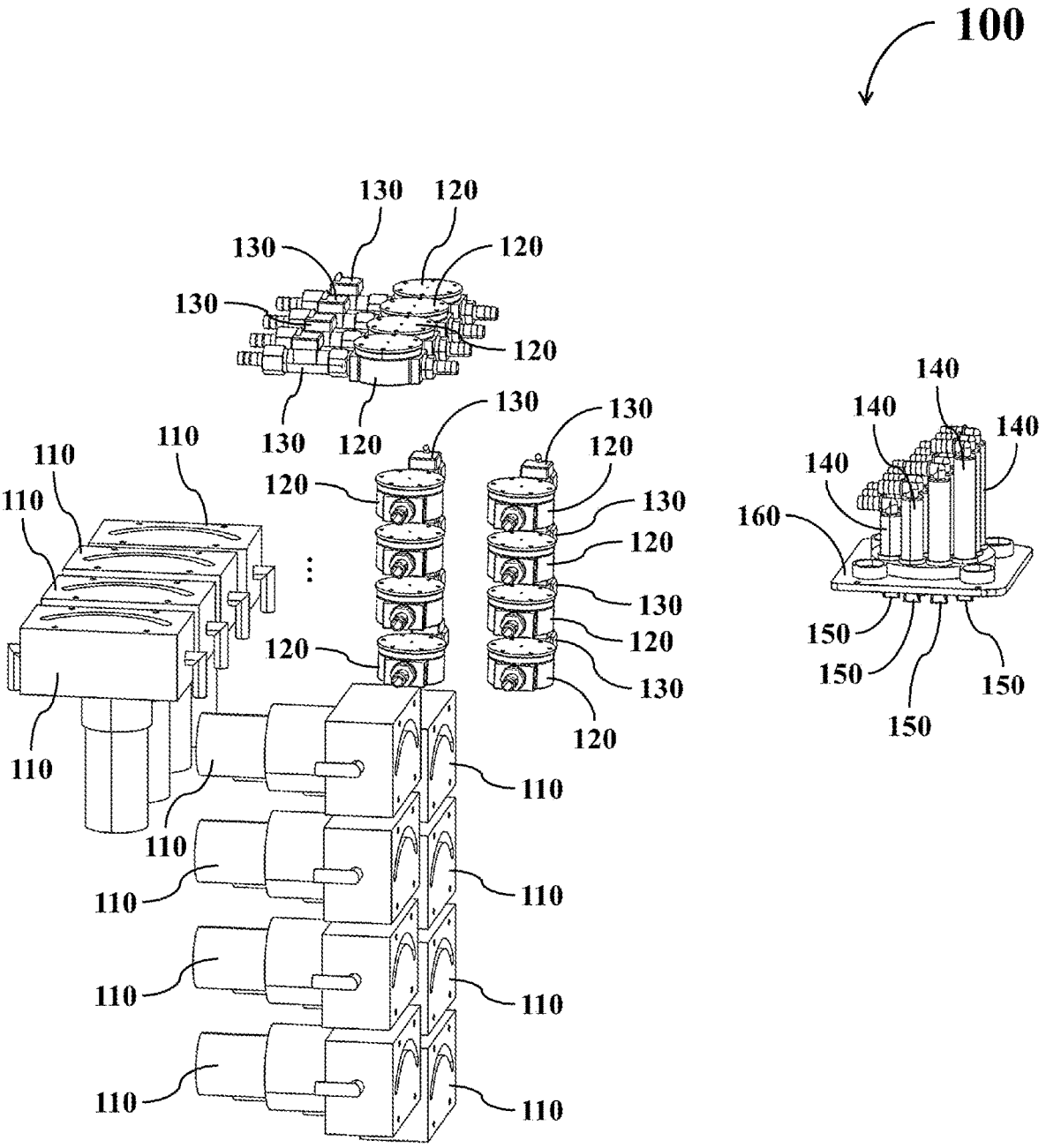
FIGS. 2-3 show simplified schematic diagrams illustrating spatial arrangement of some components inside the automated beverage preparation apparatus of FIG. 1 from different viewing angles.
Figure 3:
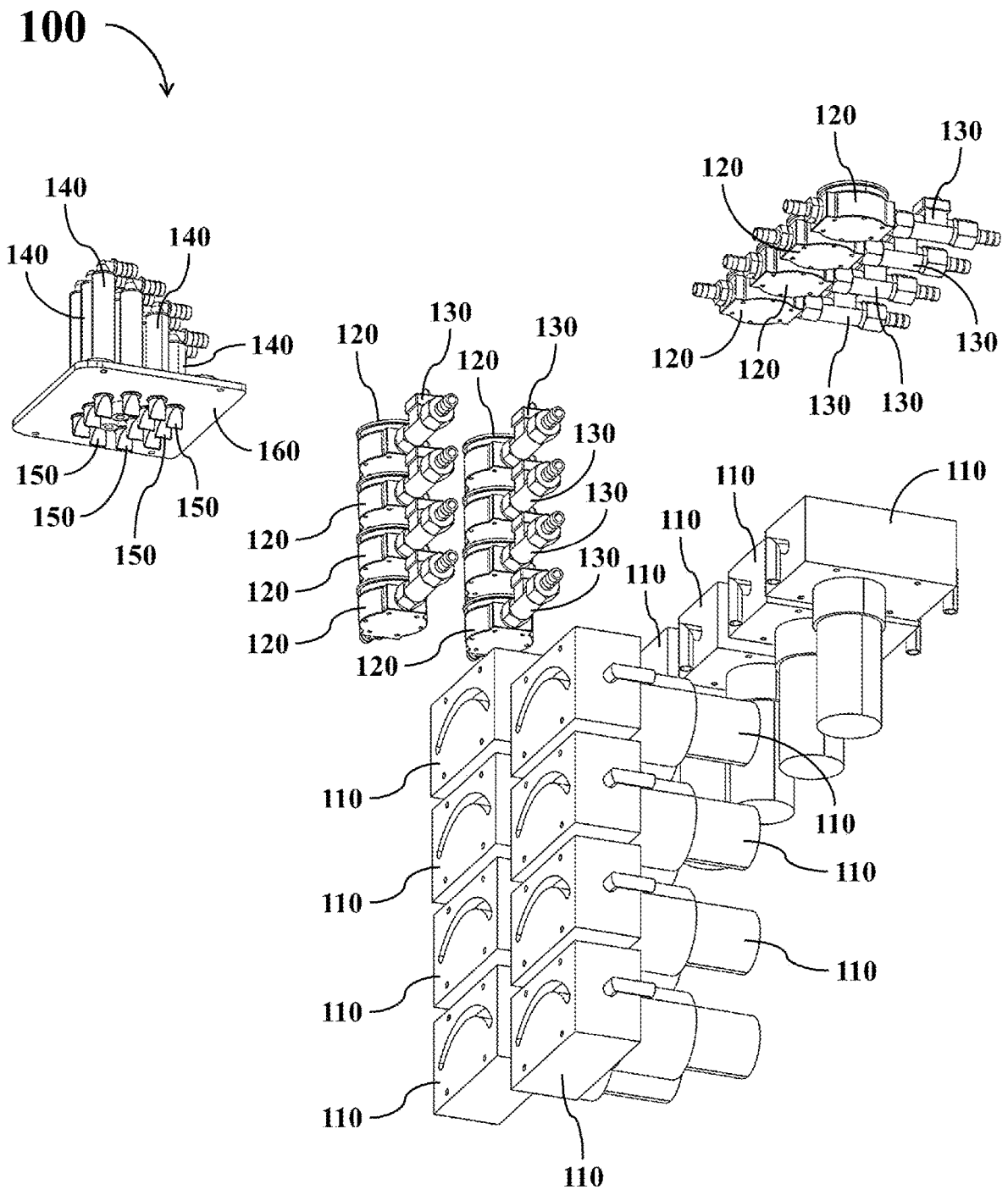
Figure 4:
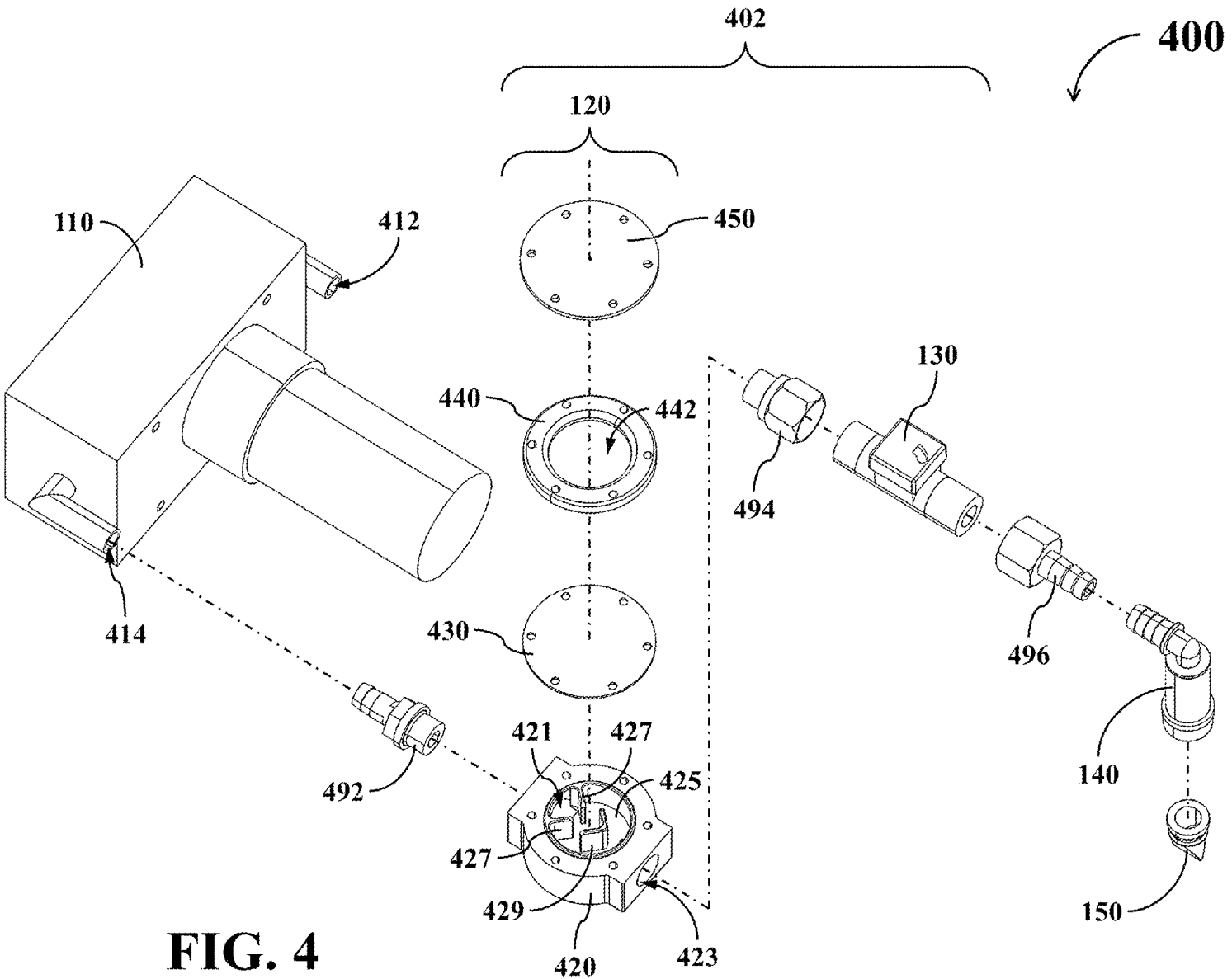
FIGS. 4-7 show schematic decomposed diagrams of a material output volume detecting device from different viewing angles according to one embodiment of the present disclosure.
Figure 5:
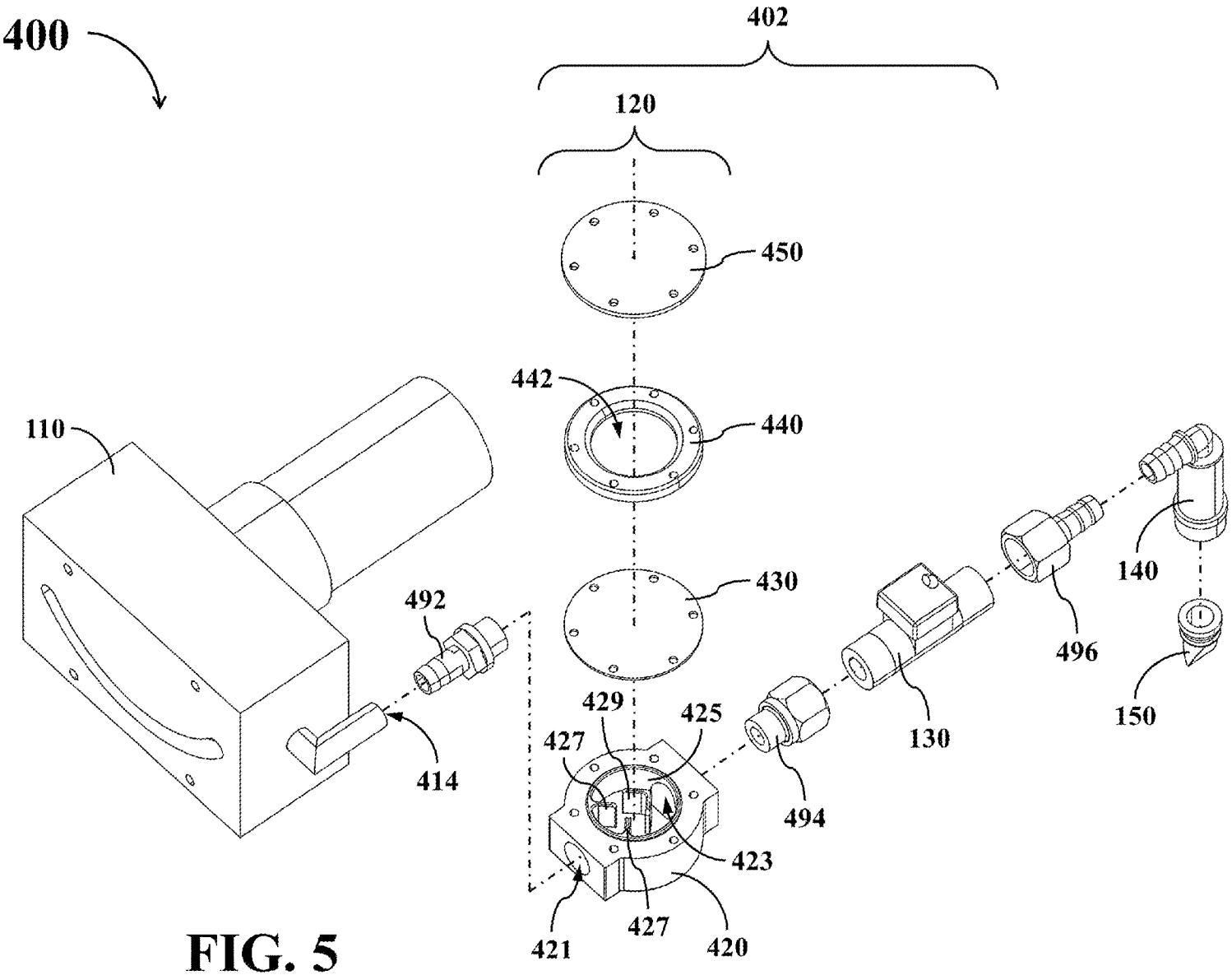
Figure 6:
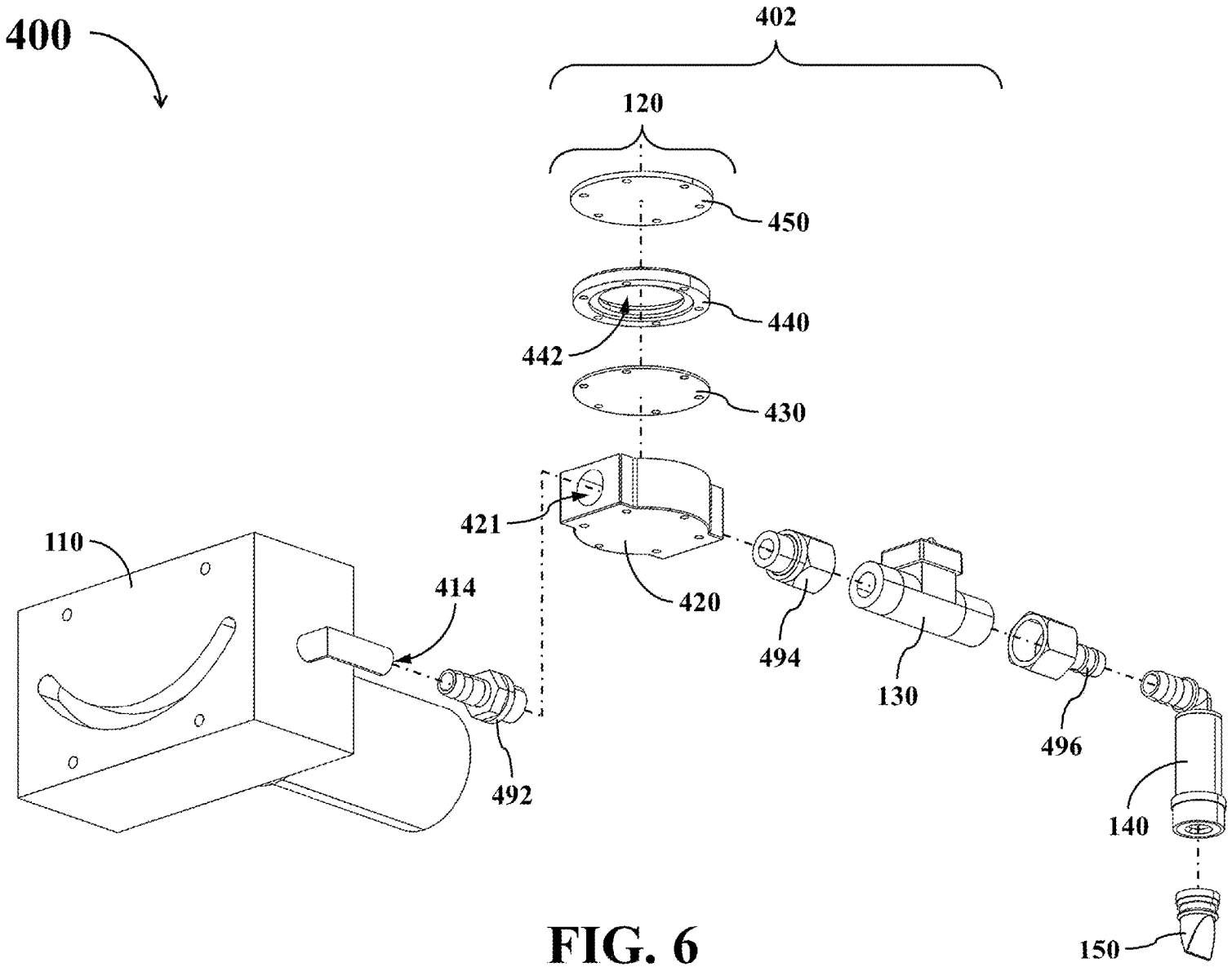
Figure 7:
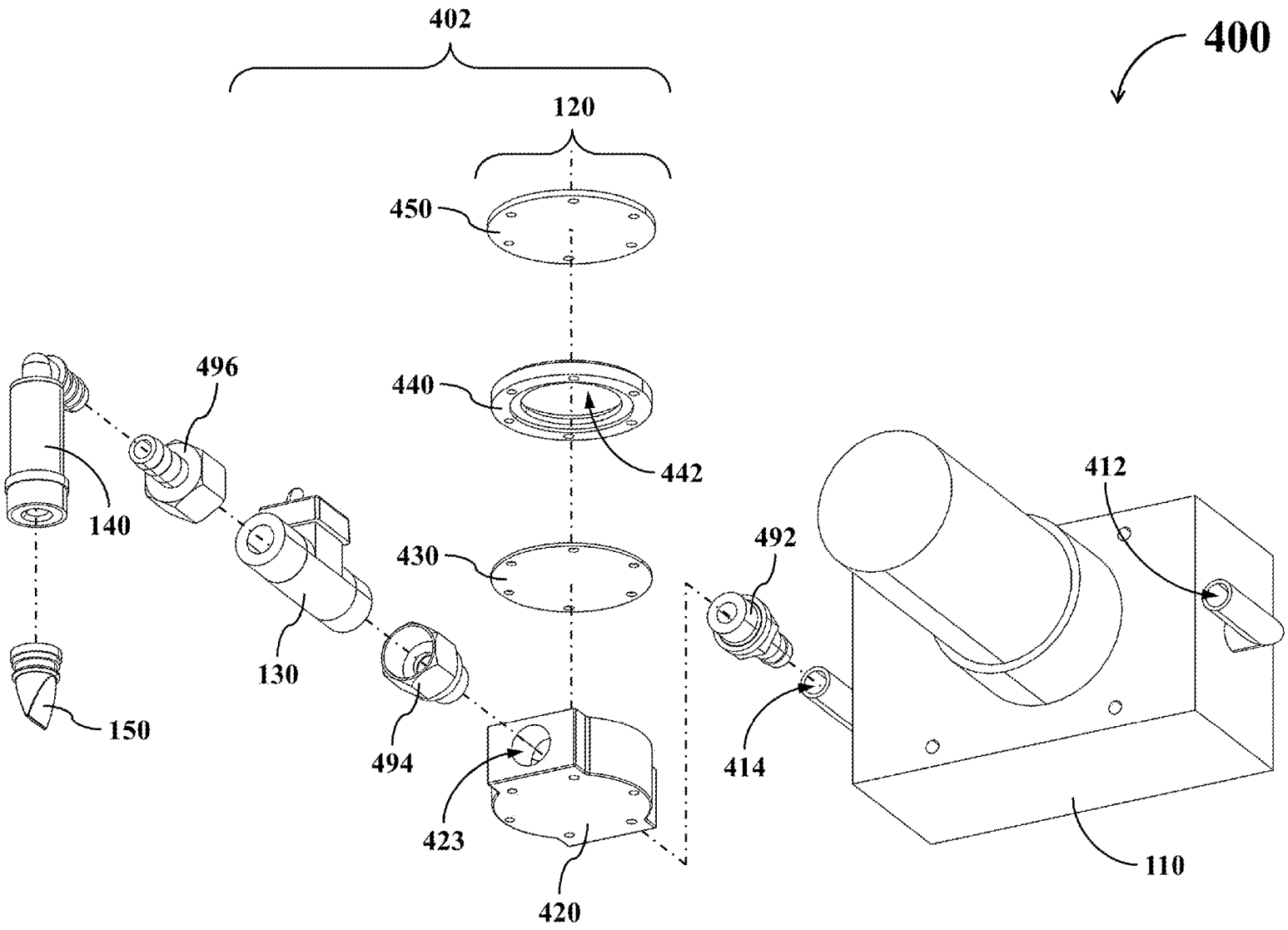

Please refer to FIG. 1 through FIG. 3. FIG. 1 shows a simplified schematic perspective diagram of an automated beverage preparation apparatus 100 according to one embodiment of the present disclosure. FIGS. 2-3 show simplified schematic diagrams illustrating spatial arrangement of some components inside the automated beverage preparation apparatus 100 from different viewing angles.

The automated beverage preparation apparatus 100 comprises an upper chamber 101, a lower chamber 103, a neck chamber 105, one or more connecting channels 107, and a control panel 109.

In order to reduce the complexity of the drawing contents, the appearance outline of the automated beverage preparation apparatus 100 is deliberately represented by dashed lines in FIG. 1, while some internal objects to be further described in the following are depicted with solid lines. Please note that the appearance shape of the automated beverage preparation apparatus 100 is merely a simplified exemplary embodiment for the purpose of explanatory convenience, rather than a restriction to the actual appearance of the automated beverage preparation apparatus 100.

The upper chamber 101 of the automated beverage preparation apparatus 100 may be connected to the neck chamber 105, and may be connected to the lower chamber 103 through the connecting channel 107. Relevant wires, signal lines, connectors, and/or material transmission pipes can be installed inside the automated beverage preparation apparatus 100 in a variety of appropriate ways.

As shown in FIG. 1 through FIG. 3, the automated beverage preparation apparatus 100 further comprises a plurality of pumps 110, a plurality of damper devices 120, a plurality of flowmeters 130, a plurality of material output tubes 140, a plurality of duck bill valves 150, and a connecting plate 160.

Each of the aforementioned pumps 110 may be connected to other components through various material transmission pipes and connectors, and may be installed within the upper chamber 101 in a variety of appropriate spatial arrangements, not restricted to the spatial arrangement shown in FIG. 1 through FIG. 3.

Each of the aforementioned damper devices 120 and flowmeters 130 may be connected to other components through various material transmission pipes and connectors, and may be installed within the upper chamber 101 and/or the neck chamber 105 in a variety of appropriate spatial arrangements, not restricted to the spatial arrangement shown in FIG. 1 through FIG. 3.

Each of the aforementioned material output tubes 140 be connected to other components through various material transmission pipes and connectors, and may be installed within the neck chamber 105 in a variety of appropriate spatial arrangements, not restricted to the spatial arrangement shown in FIG. 1 through FIG. 3.

The aforementioned duck bill valves 150 may be detachably arranged on the connecting plate 160 through various appropriate connections, and the connecting plate 160 may be detachably arranged beneath the neck chamber 105 through various appropriate connections, not restricted to the spatial arrangement shown in FIG. 1 through FIG. 3. In addition, the input terminals of respective duck bill valves 150 may be connected to the output terminal of a corresponding material output tube 140 through various material transmission pipes and connectors. The output terminals of respective duck bill valves 150 and the connecting plate 160 can be exposed outside the neck chamber 105 to facilitate the user to carry out relevant cleaning procedures.

As shown in FIG. 1, the lower chamber 103 of the automated beverage preparation apparatus 100 may be utilized to place a plurality of material containers 180. The material containers 180 may be utilized to store different liquid materials required for preparing freshly made beverages. Each material container 180 has an outlet connector 182, which may be connected to a corresponding component (e.g., a corresponding pump 110 or a corresponding damper device 120) through various material transmission pipes and connectors.

The quantity of the pumps 110, the damper devices 120, the flowmeters 130, the material output tubes 140, the duck bill valves 150, and the connecting plate 160 shown in FIG. 1 through FIG. 3 is merely an exemplary embodiment, rather than a restriction to the practical implementations.

In the automated beverage preparation apparatus 100, a pump 110, a damper device 120, a flowmeter 130, a material output tube 140, and a duck bill valve 150 may be connected by appropriate material transmission pipes and connectors to form a material dispensing device. In this embodiment, the automated beverage preparation apparatus 100 comprises a plurality of material dispensing devices, which are respectively responsible for delivering the liquid materials stored in different material containers 180 to the output terminals of corresponding duck bill valves 150.

In practice, appropriate refrigeration equipment may be installed within the automated beverage preparation apparatus 100 to extend the storage time of various liquid materials.

In order to reduce the complexity of the drawing contents, other structures and devices within the automated beverage preparation apparatus 100 are not shown in FIG. 1 through FIG. 3, such as the internal control circuit, electrical wires, signal lines, material transmission pipes connected between different components, refrigeration equipment, power supply apparatus, and relevant components and frames for supporting or securing the above components.

In operations, the user may manipulate the control panel 109 to configure one or more production parameters for the required freshly made beverage, such as beverage item, cup size, beverage volume, sugar level, ice level, and/or quantity of cups, or the like.

Then, the automated beverage preparation apparatus 100 would operate based on the parameters configured by the user to automatically utilize one or more pump 110 to extract the liquid material from one or more material containers 180, and to transmit the extracted liquid material toward corresponding material output tubes 140 through respective transmission pipes. With the continuous operation of respective pump 110, the liquid material within the material output tube 140 will be outputted to the beverage container 190 through corresponding duck bill valve 150.

Freshly made beverage of a variety of favors can be obtained by mixing different liquid materials together in the beverage container 190 according to a particular ratio, or by simple stirring after mixing the liquid materials. In practice, the beverage container 190 may be designed to support or have a blending functionality to increase the speed and uniformity of mixing the liquid materials.

The liquid materials stored in the aforementioned material containers 180 may be liquid materials which have a viscosity higher than water, for example, honey, various syrups, soy milks, nut pulps, fruit juice concentrates, fruit juices containing fruit fibers, tea-based liquids containing small particles (e.g., bubbles or tapioca balls), milk-based liquids, cooking oils, or other thick liquid material and so on.

As described previously, the traditional beverage preparation machines lack appropriate mechanisms to accurately measure the usage amount of the liquid material of the aforementioned type, and thus it usually results in undesirable situations, e.g., the liquid volume of the freshly made beverage does not meet expectation or the taste of the freshly made beverage has bias.

In order to control the liquid volume of the resulting freshly made beverage to be substantially consistent with the parameters set by the user, the automated beverage preparation apparatus 100 would continuously detect the usage amount of respective liquid material during the process of outputting respective liquid material to avoid the situation that the liquid volume of the freshly made beverage does not meet expectation or that the taste of the freshly made beverage has bias due to some liquid materials are outputted too much or insufficient.

It can be appreciated from the foregoing descriptions of FIG. 1 through FIG. 3 that the automated beverage preparation apparatus 100 contains multiple material dispensing devices for respectively delivering the liquid materials stored in different material containers 180 to the output terminals of corresponding duck bill valves 150. In practice, the aforementioned material dispensing devices may be designed to have substantially the same components and operating mechanism.

The operation of continuously detecting the usage amount of the liquid material conducted by the automated beverage preparation apparatus 100 during the process of outputting the liquid material will be further described in the following by reference to FIG. 4 through FIG. 7. FIGS. 4-7 show schematic decomposed diagrams of a material dispensing device 400 from different viewing angles according to one embodiment of the present disclosure.

In order to reduce the complexity of the drawing contents, only one material dispensing device 400 is shown in FIG. 4 through FIG. 7 as an example for explanation. The components and operating mechanism of the material dispensing device 400 can be applied to any other material dispensing device in the automated beverage preparation apparatus 100.

As shown in FIG. 4 through FIG. 7, the material dispensing device 400 comprises a pump 110, a material output volume detecting device 402, a material output tube 140, and a duck bill valve 150, wherein the material output volume detecting device 402 comprises a damper device 120 and a flowmeter 130.

The pump 110 comprises a material inlet 412 and a material outlet 414, and arranged to operably pressure the liquid material received through the material inlet 412 to push the liquid material to the material outlet 414. In practice, the pump 110 may be realized with various appropriate liquid pump devices capable of pushing liquid forward, such as a peristaltic pump, a diaphragm pump, a rotary diaphragm pump, or the like.

In this embodiment, the material inlet 412 of the pump 110 may be coupled with the outlet connector 182 of a corresponding material container 180 through appropriate connectors and material transmission pipes (not shown in FIG. 4 through FIG. 7, and arranged to operably receive the liquid material transmitted from the corresponding material container 180.

The damper device 120 in the material output volume detecting device 402 is arranged to operably conduct a buffering operation on the liquid material flowing through the damper device 120. The damper device 120 comprises a groove-shaped damper base 420, a diaphragm 430, a fastening element 440, and a restriction element 450, wherein the damper base 420 comprises a material entrance hole 421, a material exit hole 423, a material buffer chamber 425, one or more flow guiding elements 427, and a block element 429.

As shown in FIG. 4 through FIG. 7, the material buffer chamber 425 of the damper base 420 is positioned between the material entrance hole 421 and the material exit hole 423, and two flow guiding elements 427 are respectively provided on both sides close to the material entrance hole 421. In this embodiment, the material entrance hole 421 is coupled with the material outlet 414 of the pump 110, and arranged to operably receive the liquid material transmitted from the material outlet 414 of the pump 110. In other words, the material output volume detecting device 402 of this embodiment is located at the subsequent stage of the pump 110. In practice, the material entrance hole 421 may be directly connected to the material outlet 414 of the pump 110, or may be indirectly connected to the material outlet 414 of the pump 110 through a first connector 492 or other appropriate connectors and material transmission pipes (not shown in FIG. 4 through FIG. 7).

The block element 429 is positioned in the material buffer chamber 425, and located in a straight path between the material entrance hole 421 and the material exit hole 423. The block element 429 is arranged to operably prevent the liquid material from directly flowing from the material entrance hole 421 to the material exit hole 423 in a straight line path, to thereby increase the flow resistance of the liquid material when flowing in the damper device 120.

The diaphragm 430 is made by elastic materials and covered on the material buffer chamber 425 of the damper base 420.

The fastening element 440 is positioned on the diaphragm 430, and has a hollow portion 442. The fastening element 440 is arranged to operably press the diaphragm 430 onto the material buffer chamber 425 of the damper base 420 to prevent the liquid material from leaking out. In practice, screws, nails, clamping devices, or other suitable fixing elements may be used to arrange the fastening element 440 above the material buffer chamber 425 of the damper base 420, so that the diaphragm 430 is clamped between the fastening element 440 and the damper base 420.

During the operations of the aforementioned pump 110, the liquid material is intermittently pushed forward, and thus the liquid pressure at the material inlet 412 of the pump 110 exhibits periodic fluctuations. Such a situation will cause the amount of the liquid material flowing into the material buffer chamber 425 to exhibit periodic fluctuations.

When the volume of the liquid material in the material buffer chamber 425 exceeds a predetermined amount (i.e., the nominal volume of the material buffer chamber 425), the diaphragm 430 would deform to protrude outwards, so that a part of the diaphragm 430 enters the hollow portion 442 of the fastening element 440. In this situation, the amount of the liquid material in the damper device 120 will temporarily exceed the nominal volume of the material buffer chamber 425. But after a while, the elastic restoring force of the diaphragm 430 will push the liquid material in the damper device 120 toward the material exit hole 423, so that the amount of the liquid material in the damper device 120 will drop back to a level close to the nominal volume of the material buffer chamber 425.

The restriction element 450 is positioned on the fastening element 440, and arranged to operably restrain the degree of deformation of the diaphragm 430. The restriction element 450 may be realized with a sheet-shaped object, a plate-shaped object, or a block-shaped object with appropriate rigidity, such as an acrylic plate, a metal plate, a metal sheet, or a plastic plate with sufficient thickness. In practice, adhesives, screws, nails, clamping devices, or other appropriate fixing elements may be used to secure the restriction element 450 above the restriction element 450, so that the fastening element 440 and the diaphragm 430 are clamped between the restriction element 450 and the damper base 420.

The flowmeter 130 of the material output volume detecting device 402 is coupled with the output terminal of the damper device 120 (i.e., the material exit hole 423 of the damper base 420), and arranged to operably measure the flow of liquid material output from the damper device 120. In other words, the flowmeter 130 is located at the subsequent stage of the damper device 120. In practice, the flowmeter 130 may be directly connected to the material exit hole 423 of the damper base 420, or may be indirectly connected to the material exit hole 423 of the damper base 420 through a second connector 494 or other appropriate connectors and material transmission pipes (not shown in FIG. 4 through FIG. 7).

The material output tube 140 is coupled with the output terminal of the flowmeter 130, and arranged to operably transmit the liquid material passed through the flowmeter 130. In practice, the material output tube 140 may be indirectly connected to the output terminal of the flowmeter 130 through a third connector 496 with other appropriate material transmission pipes (not shown in FIG. 4 through FIG. 7) to increase the selection flexibility of the position of the material output tube 140.

The duck bill valve 150 is coupled with the output terminal of the material output tube 140, and arranged to operably output the liquid material transmitted from the material output tube 140 to the beverage container 190. In practice, the duck bill valve 150 may be directly connected to the output terminal of the material output tube 140, or may be indirectly connected to the output terminal of the material output tube 140 through the aforementioned connecting plate 160 or other appropriate material transmission pipes (not shown in FIG. 4 through FIG. 7).

As described previously, the damper device 120 of the material output volume detecting device 402 conducts a buffering treatment to the liquid material flowing through the damper device 120 with the deformation and elastic restoring force of the diaphragm 430. Accordingly, both the flow speed variation and the liquid pressure variation of the liquid material output from the material exit hole 423 of the damper device 120 will be apparently lower than the flow speed variation and the liquid pressure variation of the liquid material received by the material entrance hole 421 of the damper device 120. Such structure is beneficial for improving the measuring accuracy of the flowmeter 130 in measuring the flow of the liquid material output from the damper device 120, thereby effectively increase the liquid volume control accuracy of the automated beverage preparation apparatus 100 for freshly made beverages.

If the aforementioned damper device 120 is omitted, both the flow speed variation and the liquid pressure variation of the liquid material flowing through the flowmeter 130 will become greater. Such a situation will cause a negative impact to the measuring accuracy of the flowmeter 130 in measuring the flow of the liquid material, thereby reducing the flow measurement accuracy of the flowmeter 130.

In some embodiments, the output portion of the duck bill valve 150 may be realized with appropriate materials with elasticity. Additionally, when the material dispensing device 400 ends the current material output operation, the aforementioned pump 110 may be arranged to operably reverse operation for a predetermined period of time (e.g., 0.3 second, 0.5 second, 0.8 second, 1 second, 1.5 seconds, 2 seconds, etc.) to cause the liquid material in the material dispensing device 400 to flow backward slightly, to thereby generate a negative pressure within the duck bill valve 150, so as to render the output aperture of the duck bill valve 150 to be closed.

As a result, it can effectively prevent the liquid material within the material dispensing device 400 from dripping through the output aperture of the duck bill valve 150 after the material dispensing device 400 ends the current material output operation.

The components and operating mechanism of other material dispensing devices in the automated beverage preparation apparatus 100 are substantially the same as the foregoing material dispensing device 400. For the sake of brevity, similar descriptions will not be repeated here.

Please note that the schematic decomposed diagrams shown in FIG. 4 through FIG. 7 is merely employed to represent the connection relationship between components of the material dispensing device 400, rather than a restriction to the practical spatial arrangement of those components. In practice, the actual spatial arrangement of individual components of the material dispensing device 400 inside the automated beverage preparation apparatus 100 may be adjusted according to the needs of the internal space arrangement of the automated beverage preparation apparatus 100, and different material dispensing devices of the automated beverage preparation apparatus 100 may have different spatial arrangement for their components.

Figure 8:
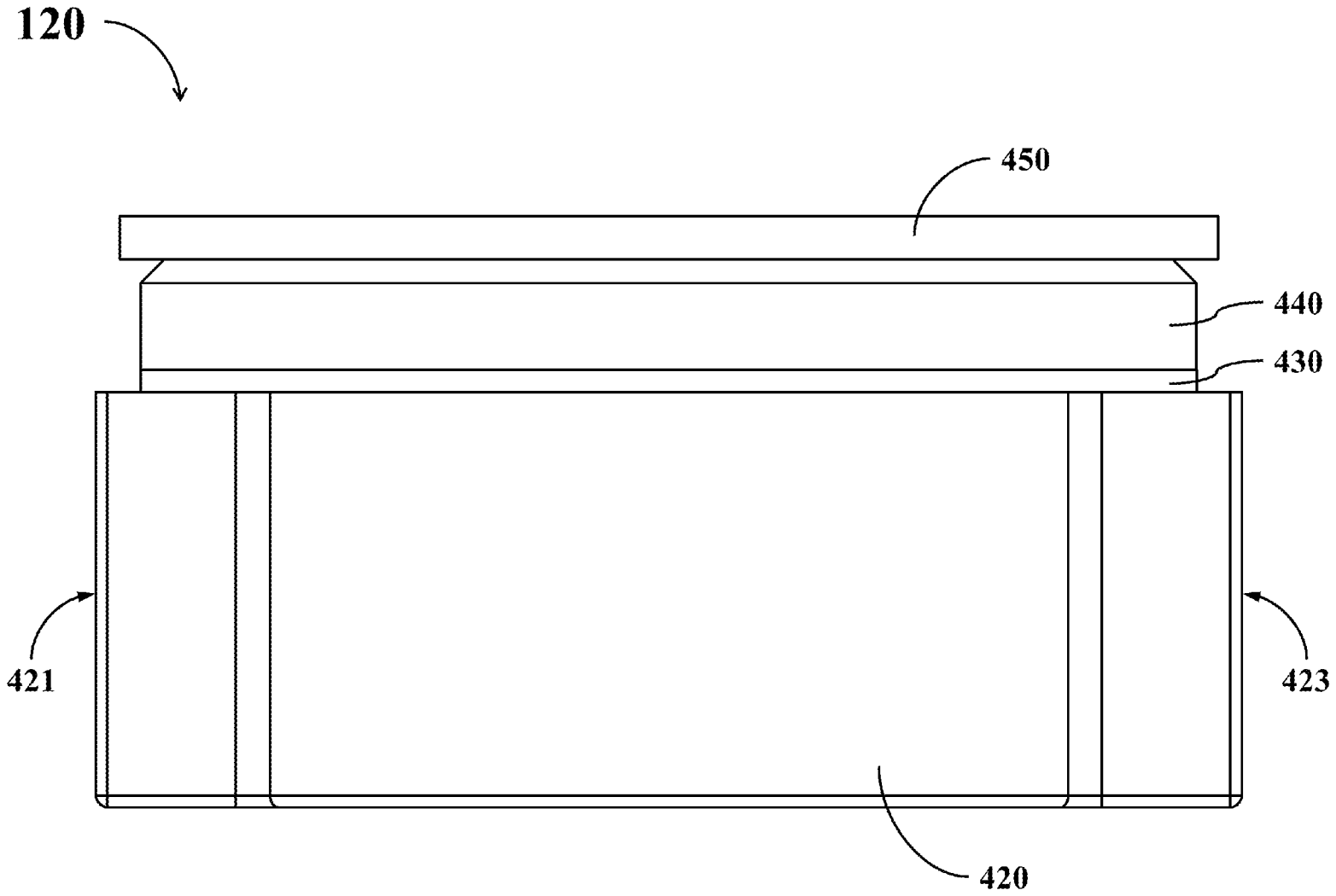
FIG. 8 shows a simplified schematic side view of a damper device according to one embodiment of the present disclosure.
Figure 9:
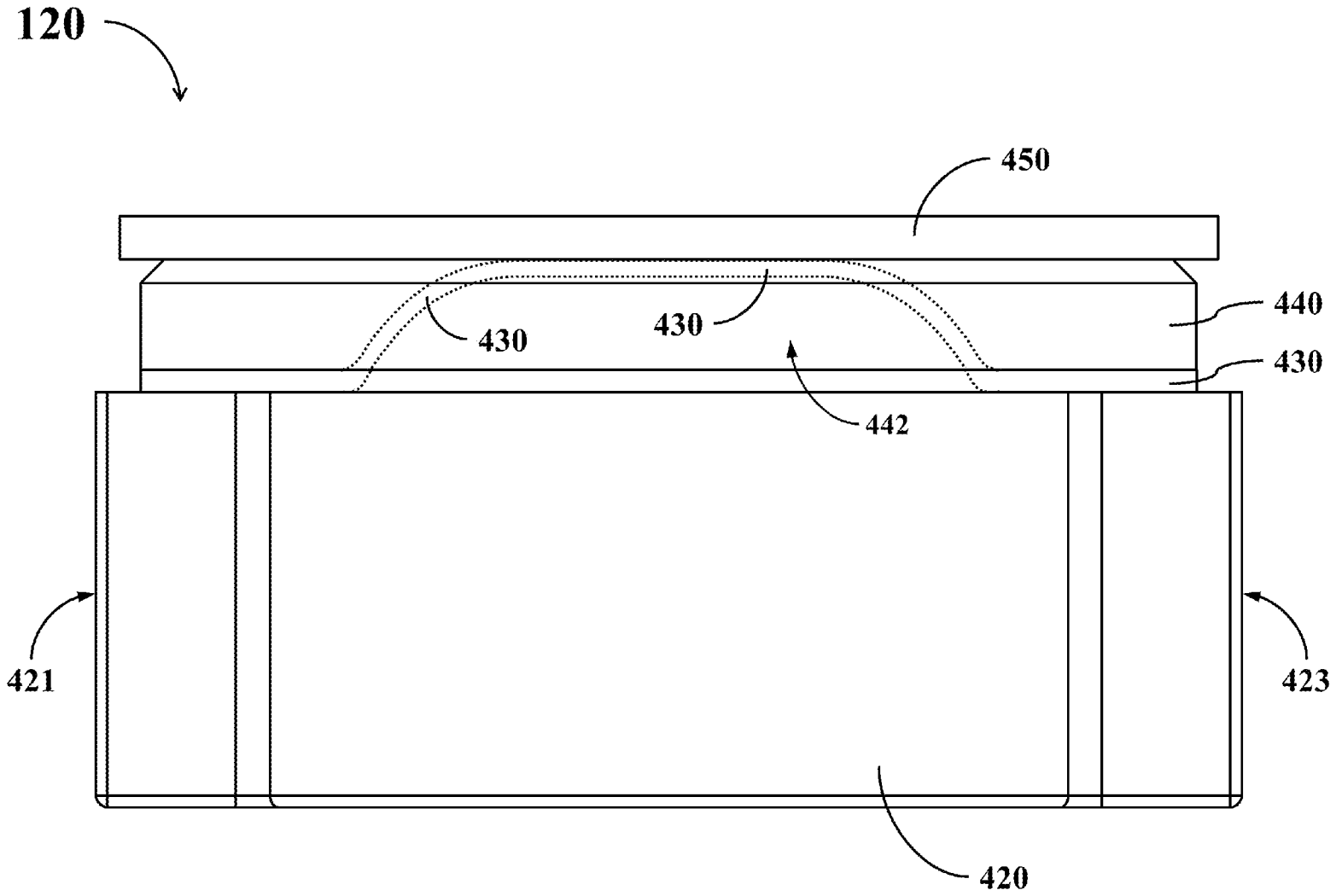
FIG. 9 shows a simplified schematic diagram illustrating the structure of the damper device of FIG. 8 when a diaphragm of the damper device deforms.

Please refer to FIG. 8 and FIG. 9. FIG. 8 shows a simplified schematic side view of the damper device 120 according to one embodiment of the present disclosure. FIG. 9 shows a simplified schematic diagram illustrating the structure of the damper device 120 of FIG. 8 when the diaphragm 430 deforms.

As shown in FIG. 8, when the components (i.e., the damper base 420, the diaphragm 430, the fastening element 440, and the restriction element 450 described above) of the damper device 120 are assembled together, the fastening element 440 presses the diaphragm 430 onto the damper base 420, and the restriction element 450 is positioned above the fastening element 440.

As described above, the restriction element 450 is realized with a sheet-shaped object, a plate-shaped object, or a block-shaped object with appropriate rigidity. Accordingly, as shown in FIG. 9, when the diaphragm 430 deforms to protrude outwards, a part of the diaphragm 430 enters the hollow portion 442, but the diaphragm 430 does not exceed the restriction element 450. In other words, the restriction element 450 can limit the degree of deformation of the diaphragm 430 within a predetermined range, and does not allow the diaphragm 430 to bulge outwards without restriction. Therefore, the arrangement of the restriction element 450 can effectively prevent the diaphragm 430 from rupturing or falling off due to excessive liquid pressure in the material buffer chamber 425.

Please refer to FIGS. 10-15, which show simplified schematic diagrams of the damper base 420 of the damper device 120 according to several embodiments of the present disclosure.

Figure 10:
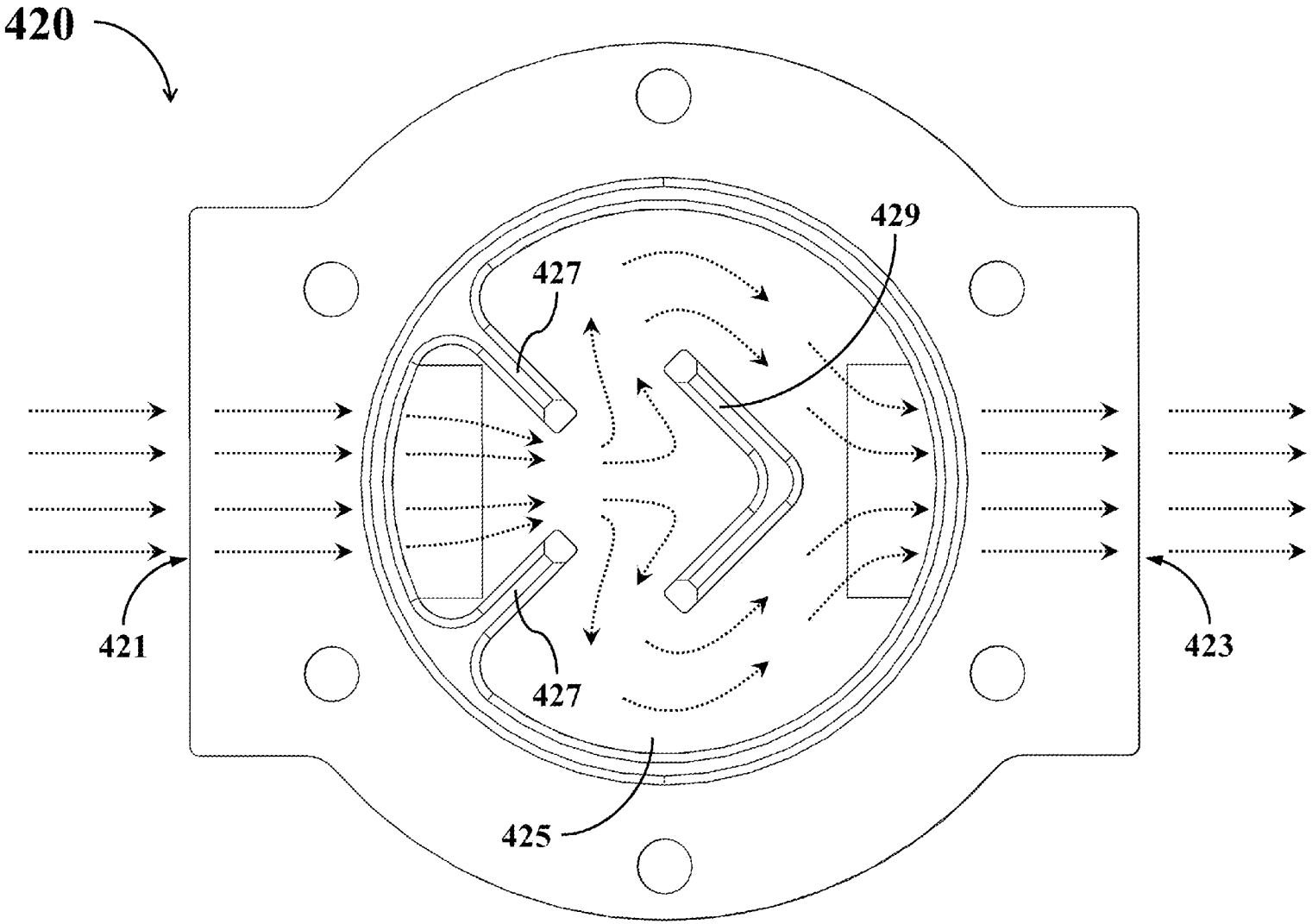
FIGS. 10-15 show simplified schematic diagrams of a damper base of the damper device according to several embodiments of the present disclosure.

FIG. 10 shows a simplified top view of the damper base 420 illustrated in the aforementioned embodiment of FIG. 4 through FIG. 7. FIG. 11 through FIG. 15 show simplified top views of the damper base 420 according to another four different embodiments of the present disclosure. In FIG. 10 through FIG. 15, dashed lines are used to indicate the possible flow of the liquid material within the material buffer chamber 425 of the damper device 120.

In the embodiment of FIG. 10, the block element 429 is a V-shaped wall element protruding upward from the bottom of the damper base 420, and the two wings of the V-shaped wall element are extended toward the side where the material entrance hole 421 resides (i.e., the left side of FIG. 10). As described previously, the arrangement of the block element 429 can prevent the liquid material from directly flowing from the material entrance hole 421 to the material exit hole 423 in a straight line path, to thereby increase the flow resistance of the liquid material when flowing, so that the flow speed of the liquid material outputted by the material exit hole 423 can become more moderate.

Figure 11:
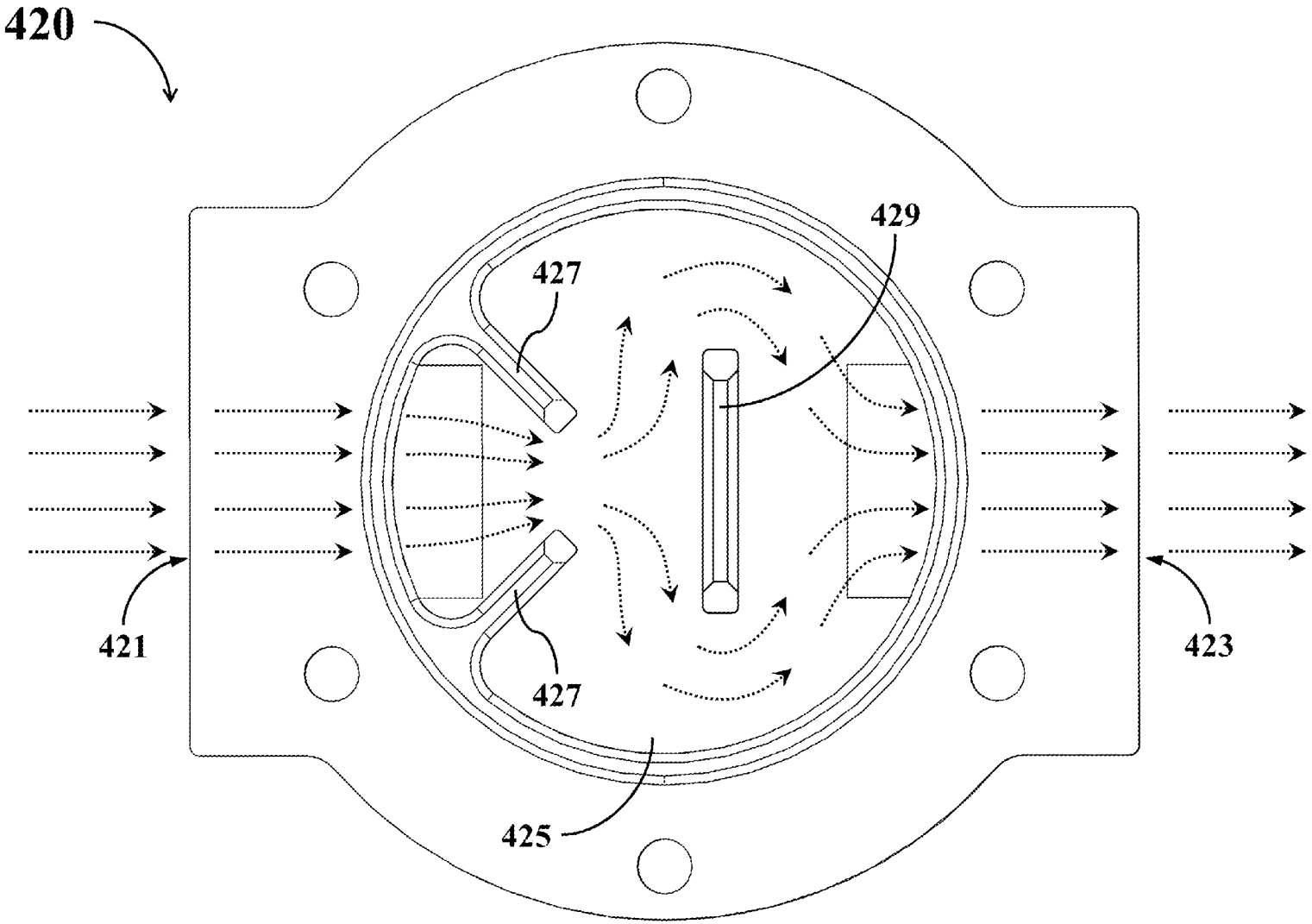

In the embodiment of FIG. 11, the positions of the two flow guiding elements 427 are the same as the embodiment of FIG. 10, and the block element 429 is an I-shaped wall element protruding upward from the bottom of the damper base 420, while the longitudinal axis of the I-shaped wall element is substantially perpendicular to the flow direction of the liquid material when it enters the material entrance hole 421.

Figure 12:
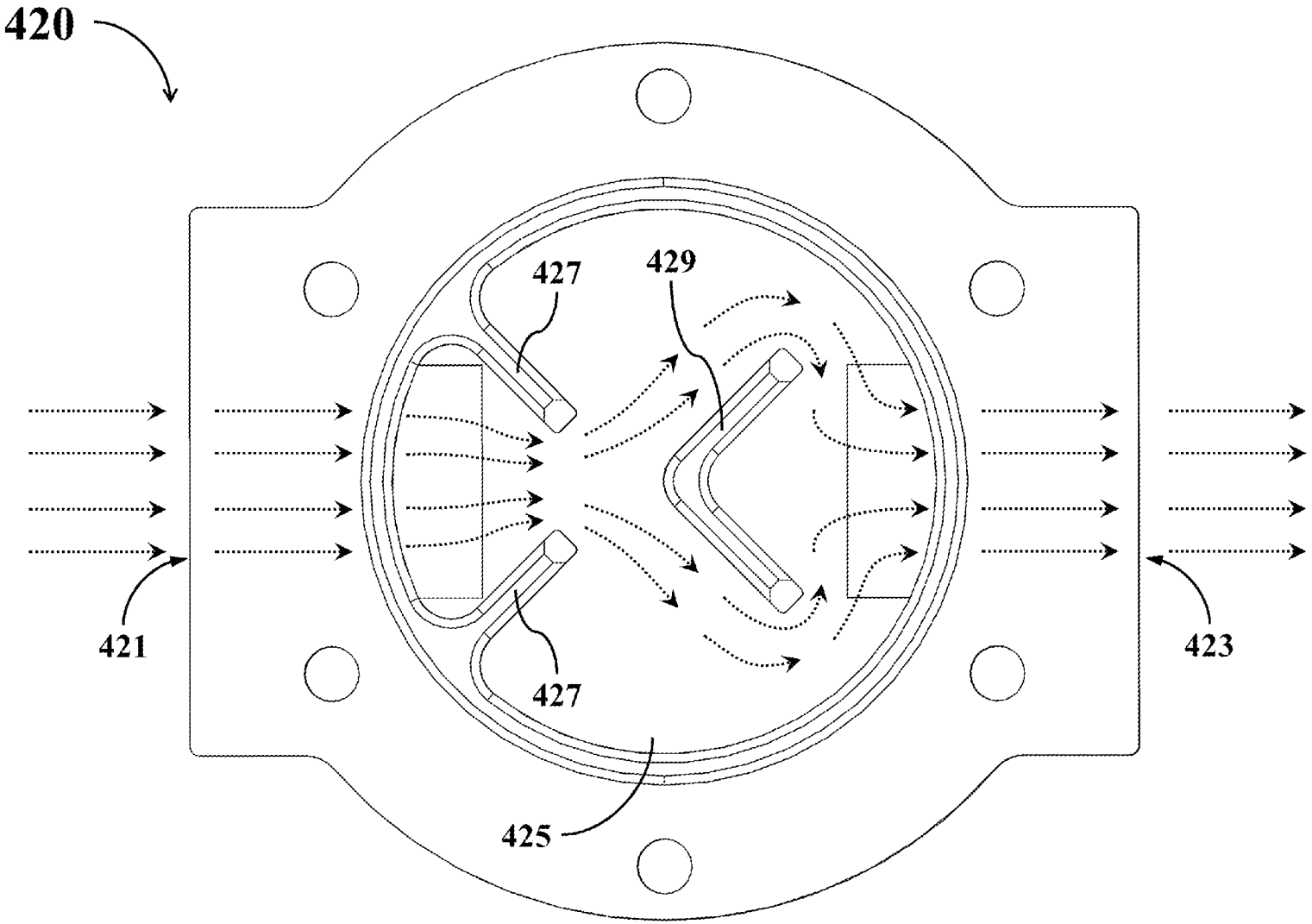

In the embodiment of FIG. 12, the positions of the two flow guiding elements 427 are the same as the embodiment of FIG. 10, and the block element 429 is a V-shaped wall element protruding upward from the bottom of the damper base 420, while the two wings of the V-shaped wall element are extended toward the side where the material exit hole 423 resides (i.e., the right side of FIG. 12).

Figure 13:
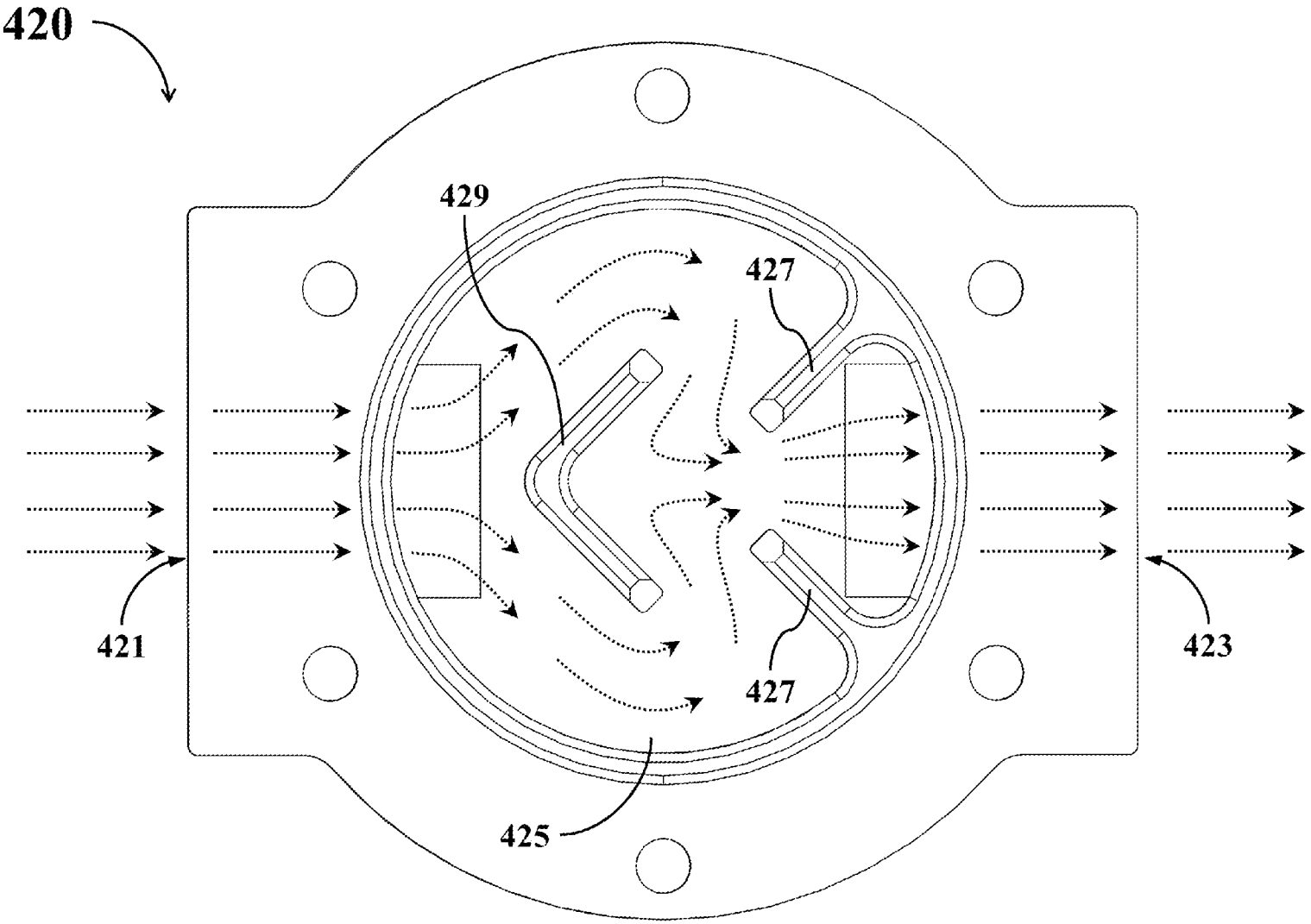

In the embodiment of FIG. 13, two flow guiding elements 427 are arranged in the material buffer chamber 425 of the damper base 420, but the positions of these two flow guiding elements 427 are different from the embodiment of FIG. 10. In this embodiment, the two flow guiding elements 427 in the damper base 420 are respectively positioned on both sides close to the material exit hole 423. Additionally, the block element 429 of this embodiment is a V-shaped wall element protruding upward from the bottom of the damper base 420, and the two wings of the V-shaped wall element are extended toward the side where the material exit hole 423 resides (i.e., the right side of FIG. 13).

Figure 14:
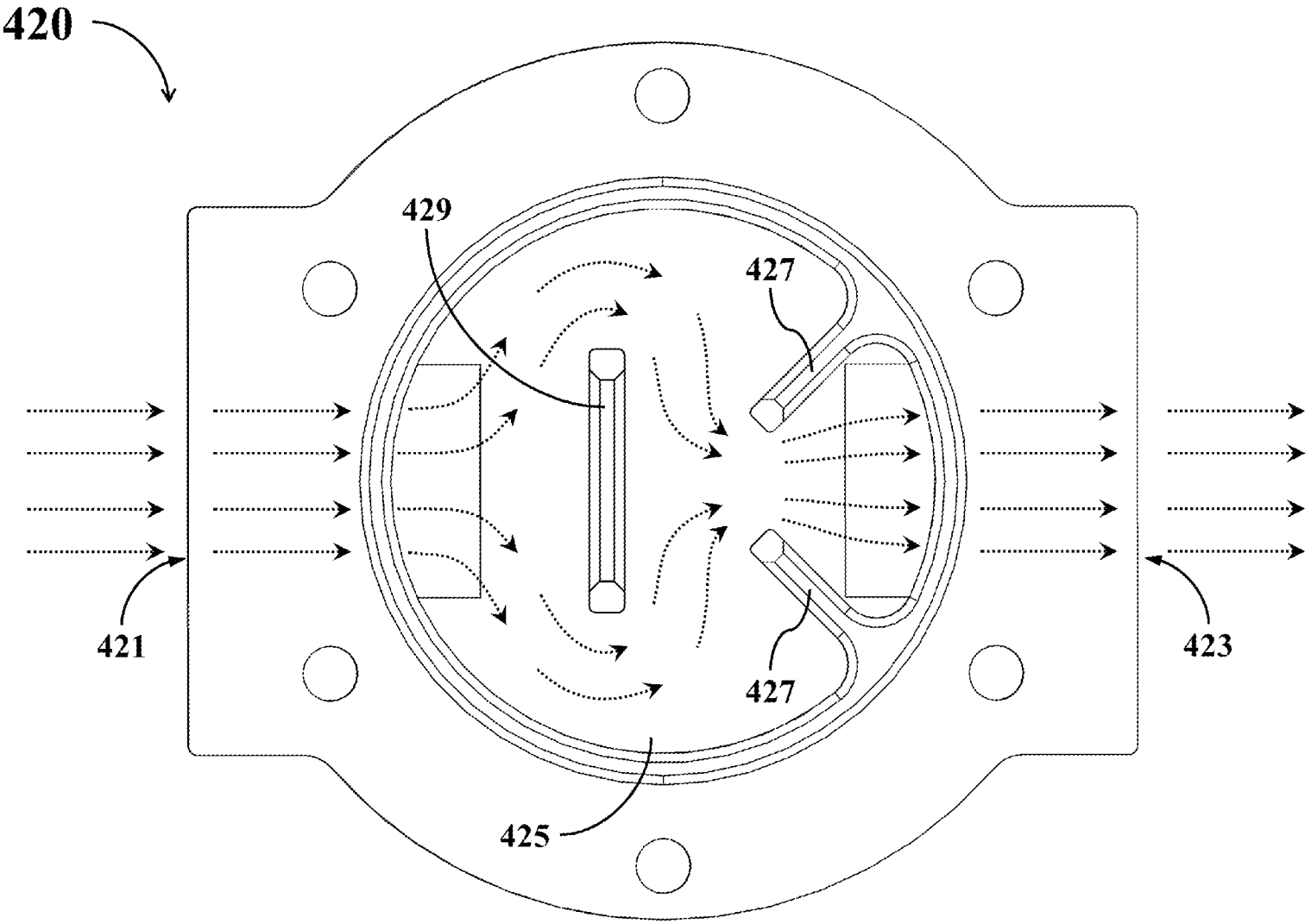

In the embodiment of FIG. 14, the positions of the two flow guiding elements 427 are the same as the embodiment of FIG. 13, and the block element 429 is an I-shaped wall element protruding upward from the bottom of the damper base 420, while the longitudinal axis of the I-shaped wall element is substantially perpendicular to the flow direction of the liquid material when it enters the material entrance hole 421.

Figure 15:
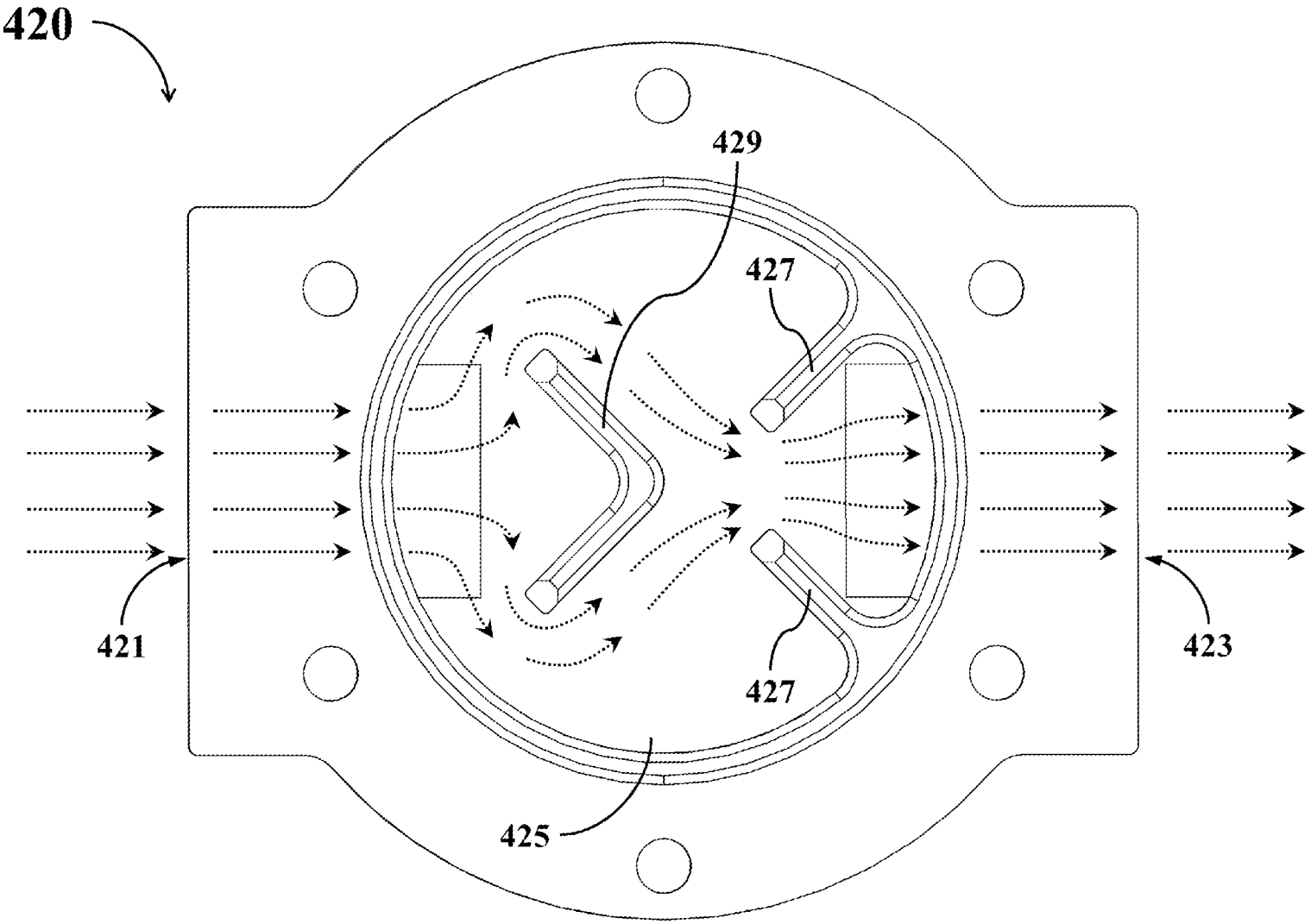

In the embodiment of FIG. 15, the positions of the two flow guiding elements 427 are the same as the embodiment of FIG. 13, and the block element 429 is a V-shaped wall element protruding upward from the bottom of the damper base 420, while the two wings of the V-shaped wall element are extended toward the side where the material entrance hole 421 resides (i.e., the left side of FIG. 15).

In the embodiments of FIG. 10 through FIG. 12, after the liquid material passes through the material entrance hole 421, the liquid material first passes through the two flow guiding elements 427 near the both sides of the material entrance hole 421, and then flows toward the block element 429. In the embodiments of FIG. 13 through FIG. 15, after the liquid material passes through the material entrance hole 421, the liquid material will be blocked by the block element 429 first, and then passes through the two flow guiding elements 427 near the both sides of the material exit hole 423.

Similar with the block element 429 in the embodiment of FIG. 10, the block element 429 in the embodiments of FIG. 11 through FIG. 15 can prevent the liquid material from directly flowing from the material entrance hole 421 to the material exit hole 423 in a straight line path, to thereby increase the flow resistance of the liquid material when flowing, so that the flow speed of the liquid material outputted by the material exit hole 423 will become more moderate.

Please note that the component structure and connections between components of the material dispensing device 400 in the aforementioned FIG. 4 through FIG. 7 is merely an exemplary embodiment, rather than a restriction to the practical implementations of the material dispensing device 400.

In some embodiment, for example, the material output volume detecting device 402 may be instead located at the prior stage of the pump 110. Specifically, the material entrance hole 421 of the damper device 120 may instead be coupled with the outlet connector 182 of a corresponding material container 180 through appropriate connectors and material transmission pipes (not shown in the drawings), so as to receive the liquid material transmitted from the corresponding material container 180. On the other hand, the material inlet 412 of the pump 110 may instead be coupled with the output terminal of the flowmeter 130, so as to receive the liquid material passed through the flowmeter 130. In practice, the material inlet 412 of the pump 110 may be directly connected to the output terminal of the flowmeter 130, or may be indirectly connected to the output terminal of the flowmeter 130 through appropriate connectors or material transmission pipes (not shown in the drawings).

For another example, in some embodiments, the aforementioned block element 429 in the damper base 420 may be modified to be a C-shaped wall element protruding upward from the bottom of the damper base 420, and the opening of the C-shaped wall element may face the material entrance hole 421 or the material exit hole 423. Alternatively, the block element 429 may be designed to have other appearance that can prevent the liquid material from directly flowing from the material entrance hole 421 to the material exit hole 423 in a straight line path.

For another example, in some embodiments, the quantity of the flow guiding element 427 and/or the block element 429 in the foregoing damper base 420 may be increased.

For another example, in some embodiments, the flow guiding element 427 in the foregoing damper base 420 may be omitted.

For another example, in some embodiments, the fastening element 440 and the restriction element 450 may be integrated into a single device by using an integrally forming approach, a 3D printing approach, or other appropriate methods.

For another example, in some embodiments, the foregoing duck bill valve 150 may be replaced with check valve of other types.

It can be appreciated from the foregoing elaborations, by utilizing the disclosed damper device 120 to conduct a buffering operation on the liquid material flowing therethrough, the measurement accuracy of the flowmeter 130 in measuring the flow of the liquid material output from the damper device 120 can be significantly improved, thereby effectively increasing the liquid volume control accuracy of the disclosed automated beverage preparation apparatus 100 for resulting freshly made beverages.

Even if the liquid materials employed by the automated beverage preparation apparatus 100 are liquids having a viscosity higher than water, for example, honey, various syrups, soy milks, nut pulps, fruit juice concentrates, fruit juices containing fruit fibers, tea-based liquids containing small particles (e.g., bubbles or tapioca balls), milk-based liquids, cooking oils, or other thick liquid material and so on, the usage amount of corresponding liquid material can be accurately measured by adopting the structure of the disclosed material output volume detecting device 402.

Accordingly, the disclosed automated beverage preparation apparatus 100 is capable of accurately controlling the material output volume of respective liquid materials, and thus it is enabled to maintain the taste consistency of resulting freshly made beverages.

In addition, the disclosed automated beverage preparation apparatus 100 may operate based on the parameters configured by the user to automatically utilize multiple material dispensing devices to extract and transmit liquid materials multiple material containers 180, and to output the extracted liquid materials to the beverage container 190 through corresponding duck bill valves 150, to thereby achieve the automatic preparation of freshly made beverages. Therefore, the disclosed automated beverage preparation apparatus 100 not only effectively reduces the time and cost required for personnel training, but also significantly reduces the labor time required for involving in the preparation of the freshly made beverages.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Throughout the description and claims, the term "element" contains the concept of component, layer, or region.

In the drawings, the size and relative sizes of some elements may be exaggerated or simplified for clarity. Accordingly, unless the context clearly specifies, the shape, size, relative size, and relative position of each element in the drawings are illustrated merely for clarity, and not intended to be used to restrict the claim scope.

For the purpose of explanatory convenience in the specification, spatially relative terms, such as "on," "above," "below," "beneath," "higher," "lower," "upward," "downward," and the like, may be used herein to describe the function of a particular element or to describe the relationship of one element to another element(s) as illustrated in the drawings. It will be understood that the spatially relative terms are intended to encompass different orientations of the element in use, in operations, or in assembly in addition to the orientation depicted in the drawings. For example, if the element in the drawings is turned over, elements described as "on" or "above" other elements would then be oriented "under" or "beneath" the other elements. Thus, the exemplary term "beneath" can encompass both an orientation of above and beneath.

Throughout the description and claims, it will be understood that when a component is referred to as being "positioned on," "positioned above," "connected to," "engaged with," or "coupled with" another component, it can be directly on, directly connected to, or directly engaged with the other component, or intervening component may be present. In contrast, when a component is referred to as being "directly on," "directly connected to," or "directly engaged with" another component, there are no intervening components present.

Other embodiments of the invention will be apparent to those skilled in the art from consideration of the specification and practice of the invention disclosed herein. It is intended that the specification and examples be considered as exemplary only, with a true scope and spirit of the invention indicated by the following claims.

What is claimed is:

1. A material dispensing device (400) of an automated beverage preparation apparatus (100), the material dispensing device (400) comprising:

a pump (110), comprising a material inlet (412) and a material outlet (414), wherein the pump (110) is arranged to operably pressure liquid material received through the material inlet (412) to push the liquid material to the material outlet (414);

a damper device (120), arranged to operably buffer liquid material flowing through the damper device (120);

a flowmeter (130), coupled with the damper device (120), arranged to operably measure a flow of the liquid material outputted from the damper device (120); and a material output tube (140);

wherein the damper device (120) comprises:

a damper base (420), comprising a material entrance hole (421), a material exit hole (423), and a material buffer chamber (425) located between the material entrance hole (421) and the material exit hole (423), wherein the material entrance hole (421) is arranged to operably transmit received liquid material to the material buffer chamber (425), the material buffer chamber (425) is arranged to temporarily store the liquid material flowing into the material buffer chamber (425), and the material exit hole (423) is arranged to operably transmit the liquid material passed through the material buffer chamber (425) toward the flowmeter (130);

a block element (429), positioned in the material buffer chamber (425) and located in a straight path between the material entrance hole (421) and the material exit hole (423), arranged to operably prevent the liquid material from directly flowing from the material entrance hole (421) to the material exit hole (423) in a straight line path;

a diaphragm (430), covered on the material buffer chamber (425); and a fastening element (440), positioned on the diaphragm (430) and having a hollow portion (442);

wherein when a volume of the liquid material within the material buffer chamber (425) exceeds a predetermined amount, the diaphragm (430) deforms to protrude outward, so that a part of the diaphragm (430) enters the hollow portion (442) of the fastening element (440).

2. The material dispensing device (400) of claim 1, wherein the damper device (120 further comprises:

a restriction element (450), positioned on the fastening element (440), arranged to operably restrain a degree of deformation of the diaphragm (430).

3. The material dispensing device (400) of claim 2, wherein when the diaphragm (430) deforms to protrude outward, a part of the diaphragm (430) enters the hollow portion (442), but does not exceed the restriction element (450).

4. The material dispensing device (400) of claim 2, wherein the material inlet (412) of the pump (110) is arranged to operably receive liquid material transmitted from a material container (180), the material entrance hole (421) of the damper device (120) is arranged to operably receive the liquid material transmitted from the material outlet (414) of the pump (110), and the material output tube (140) is arranged to operably transmit the liquid material passed through the flowmeter (130).

5. The material dispensing device (400) of claim 2, wherein the material entrance hole (421) of the damper device (120) is arranged to operably receive liquid material transmitted from a material container (180), the material inlet (412) of the pump (110) is arranged to operably receive the liquid material passed through the flowmeter (130), and the material output tube (140) is arranged to operably transmit the liquid material transmitted from the material outlet (414) of the pump (110).

6. The material dispensing device (400) of claim 2, further comprising:

a duck bill valve (150), coupled with the material output tube (140), arranged to operably output the liquid material transmitted from the material output tube (140).

7. The material dispensing device (400) of claim 6, wherein an output portion of the duck bill valve (150) is elastic.

8. The material dispensing device (400) of claim 7, wherein when the material dispensing device (400) ends a current material output operation, the pump (110) is further arranged to operably reverse operation for a predetermined period of time to generate a negative pressure within the duck bill valve (150), so as to render an output aperture of the duck bill valve (150) to be closed.

* * * * *